US005341713A

United States Patent [19]

Okamoto et al.

[11] Patent Number: 5,341,713

[45] Date of Patent: Aug. 30, 1994

[54] CUTTING APPARATUS FOR CORRUGATED CARDBOARD SHEETS

[75] Inventors: Arifumi Okamoto, Mihara; Ikuo Shibayama, Tatebayashi, both of Japan

[73] Assignee: Mitsubishi Jukogyo Kabushiki Kaisha, Tokyo, Japan

[21] Appl. No.: 52,273

[22] Filed: Apr. 14, 1993

Related U.S. Application Data

[63] Continuation of Ser. No. 832,591, Feb. 7, 1992, abandoned.

[30] Foreign Application Priority Data

Feb. 28, 1991 [JP] Japan ..... 3-16452

[51] Int. Cl.[5] ..... B26D 1/15; B26D 3/08

[52] U.S. Cl. ..... 83/865; 83/407; 83/433; 83/508.2

[58] Field of Search ..... 83/508.2, 498, 433, 83/499, 879, 51, 885, 883, 863, 864, 407, 865

[56] References Cited

U.S. PATENT DOCUMENTS

| | | | |
|---|---|---|---|
| Re. 32,986 | 7/1989 | Dettlebach et al. | 83/883 |
| 320,650 | 6/1885 | Goettler | 83/433 |
| 1,998,357 | 4/1935 | Carlson | 83/864 |
| 2,224,070 | 12/1940 | Walter | 83/433 |
| 2,529,210 | 11/1950 | Butler | 83/883 |
| 3,422,714 | 1/1696 | Van Gompel et al. | 83/498 |
| 3,508,460 | 4/1970 | Goettsch et al. | 83/56 |
| 3,886,833 | 6/1975 | Gunn et al. | 83/499 |
| 3,935,776 | 2/1976 | Dingus | 83/433 X |
| 3,956,957 | 5/1976 | Corse | 83/499 X |
| 4,094,217 | 6/1978 | Exline | 83/473 X |
| 4,102,227 | 7/1978 | Simko | 83/498 X |
| 4,649,782 | 3/1987 | Cavagna | 83/499 X |
| 4,732,069 | 3/1988 | Wood et al. | 83/87 X |

FOREIGN PATENT DOCUMENTS 3925472 2/1990 Fed. Rep. of Germany .

OTHER PUBLICATIONS

European Search Report dated Jun. 5, 1992.

*Primary Examiner*—Richard K. Seidel
*Assistant Examiner*—Kenneth E. Peterson
*Attorney, Agent, or Firm*—Rothwell, Figg, Ernst & Kurz

[57] ABSTRACT

In the present invention, complete cutting is carried out by primary and secondary cutting devices without causing the crush, break or crack of a cut portion even in the case of a composite paper sheet such as a thick corrugated cardboard sheet or the like. There is provided a cutting apparatus for corrugated cardboard sheets which cuts and separates a corrugated cardboard sheet along the direction of travel and positioned upstream from a cylinder cutting portion. The cylinder cutting portion performs secondary cutting and consists of a knife cylinder having a knife and an anvil cylinder. The primary cutting device is provided with a cutter knife for performing primary cutting and is fixed to a bracket and is capable of movement and adjustment in the widthwise direction of the sheet. At the opposite side with respect to the corrugated cardboard sheet is provided a sheet guide capable of movement on a guide rod so as to change a relative position (gap) with respect to the cutter knife.

6 Claims, 6 Drawing Sheets

CUTTING APPARATUS FOR CORRUGATED CARDBOARD SHEETS

This is a continuation of application Ser. No. 07/832,591, filed Feb. 7, 1992, now abandoned.

BACKGROUND OF THE INVENTION

1. Field of the Invention

The present invention relates to a cutting apparatus for corrugated cardboard sheets for slitting a corrugated cardboard sheet along the traveling direction of the sheet.

2. Description of the Prior Art

FIG. 6 to FIG. 8 are figures for explaining the construction and function of a cutting apparatus for corrugated cardboard sheets in the prior art, which show a die cutter portion of a corrugated cardboard processing machine as an example. In addition, FIG. 9 is an illustrative figure of construction of a general corrugated cardboard processing machine, and FIG. 10 is a figure for explaining processing states of a corrugated cardboard sheet which corresponds to the processing machine in FIG. 9 with respect to upper and lower positions.

At first, the die cut portion, which is installed in the corrugated cardboard processing machine shown in FIG. 9, has a mechanism for performing die cutting processing to obtain a predetermined product shape with respect to a corrugated cardboard sheet 5 conveyed from a paper supply portion 17 one by one to pass through one set or plural sets of printing portions 18*a* and 18*b* to be subjected to predetermined printing, which is such a portion in which die cutting and separation are performed at once to obtain plural sheets of product sheets 19 from one sheet of the corrugated cardboard sheet 5 in the widthwise direction of the machine as 2 sheets or 3 sheets (as called two takes or three takes).

As exemplified in FIG. 6 to FIG. 8, a sheet cutting portion in the above-mentioned die cut portion is constituted by a knife cylinder 2 to which a knife 4 is secured at the outer circumferential surface via a knife mounting stand 3 and an anvil cylinder 1, and by means of pinching and opposing rotation of the knife 4 of the same knife cylinder 2 and the anvil cylinder 1, the corrugated cardboard sheet 5, which travels between the both cylinders 1 and 2 with being pinched and conveyed by sending rolls 21*a* and 21*b*, is cut.

In the cutting apparatus for corrugated cardboard sheets in the prior art shown in the above-mentioned FIG. 6 to FIG. 8, in order to carry the process between the contact of the knife 4 with the traveling sheet 5 and the completion of cutting in one step, there have been several disadvantages. For example, in the case of a composite paper sheet such as the thick corrugated cardboard sheet 5 comprising core paper (center core) 15 and liners 14 and 16 or the like, the sudden force action accompanied by the pressurized pinching of the knife causes the cut portion to be crushed, and the liner 16 is suddenly pulled by compression, resulting in occurrence of breaks at the liner portion closely adjacent to an engaging portion of the knife 4. Also, cracks generally called footprints of a crow and the like are created.

SUMMARY OF THE INVENTION

The present invention has been proposed in order that the above-mentioned problems in the prior art are solved.

Thus the present invention lies in a cutting apparatus which cuts and separates a corrugated cardboard sheet along the proceeding direction wherein it is provided with a bracket which is positioned upstream from a sheet cutting portion and is capable of movement and adjustment in the widthwise direction of the sheet, the same bracket is provided with a cutter knife having a knife edge capable of adjustment, and a sheet guide is provided at the opposite side with respect to the corrugated cardboard sheet as a material to be cut so as to change a relative position with respect to said cutter knife.

Using the cutter knife provided at the upstream side in the cutting apparatus, into the traveling corrugated cardboard sheet makes a preliminary cut having a predetermined depth (only the liner paper is cut), after which a secondary cut is performed by the above-mentioned cutting apparatus, and the complete cutting is carried out by means of the double cutting process. Thereby the cracks at the surface liner portion (generally called as footprints of a crow) having been apt to occur especially in cutting of composite paper sheets such as double-sided corrugated cardboard sheets and the like and the crush in the wave-shaped portion of the core paper disappear. As a result, the increase in quality of products can be contemplated.

DETAILED DESCRIPTION OF THE PREFERRED EMBODIMENTS

Figure 1:
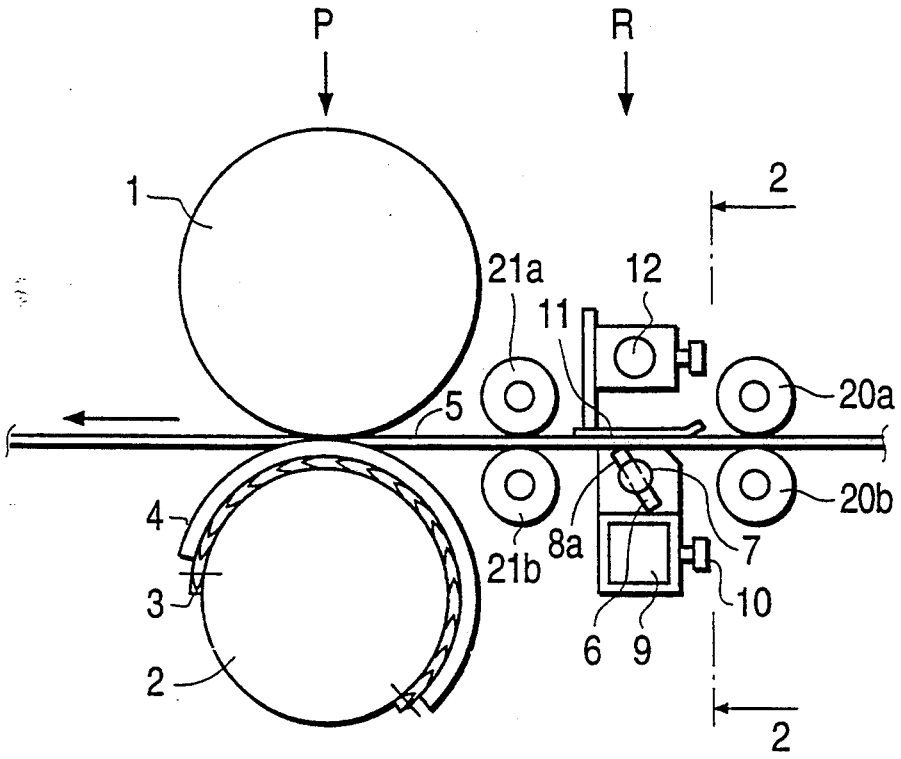
FIG. 1 is a side view of the cutting apparatus for corrugated cardboard sheets showing an embodiment of the present invention.
Figure 2:
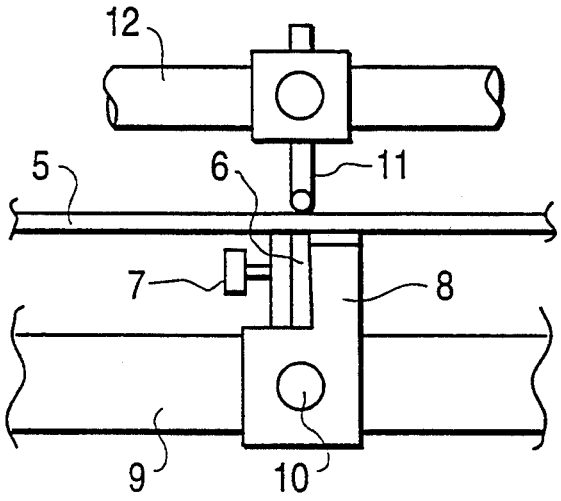
FIG. 2 is a view as viewed from the arrow A—A in FIG. 1.

In the following explanation of the present invention with respect to an embodiment with reference to the drawings, FIG. 1 to FIG. 5 are figures for explaining the construction and function of the cutting apparatus for corrugated cardboard sheets according to the present invention, which exemplify the cutting apparatus of a type in which a knife and an anvil cylinder are provided at opposing upper and lower sides with respect to a sheet pass line. At first, the structure will be explained as follows. As shown in FIG. 1, there are provided the anvil cylinder 1 and the knife cylinder 2 provided at opposing upper and lower sides with respect to the sheet pass line, and there are arranged a sheet cutting apparatus for performing known secondary cutting constructed such that a corrugated cardboard sheet 5 travels between the anvil cylinder 1 and the knife cylinder 2 by pinching and rotation by a knife 4 secured via s knife mounting stand 3 provided at the circumferential surface of the same knife cylinder 2 and the anvil cylinder 1. A cutter knife is also provided performing primary cut at the upstream side adjacent to the same sheet cutting apparatus.

The cutter knife 6 is constructed to be capable of fixing at a predetermined position together with movement in upper and lower directions with respect to a bracket 8 via a fixed screw 7 inserted into a groove 8*a* of the bracket. In addition, the above-mentioned bracket 8 engages with a tie bar 9 latitudinally provided in the widthwise direction of the machine, which can be moved in the axial direction of the same tie bar 9 and can be fixed at a predetermined position in the axial direction by means of a fixing bolt 10. On the other hand, at an upper portion with respect to the sheet pass line is installed a pushing bar 11, and the same pushing bar 11 can engage with a guide rod 12 to be moved in the axial direction in the same manner as the above-mentioned bracket 8, which can be fixed at a predetermined position. In addition, the pushing bar 11 is capable of adjustment of distance (gap) up to a knife edge of the knife (the upper end of the bracket) with any suitable ascending and descending means as illustrated at element 25 in FIG. 1, so as to make it possible to meet various sheet thicknesses accompanied by flute change of the corrugated cardboard sheet 5. Incidentally, the above-mentioned pushing bar 11 functions so as to prevent escape of the corrugated cardboard sheet 5 toward the upper side at the beginning of cutting or during cutting due to the action of the cutter knife 6. In addition, 20*a*, 20*b*, 21*a*, 21*b* in FIG. 1 are sending rolls for pinching and conveying the corrugated cardboard sheet 5 located at the mid section.

Figure 3:
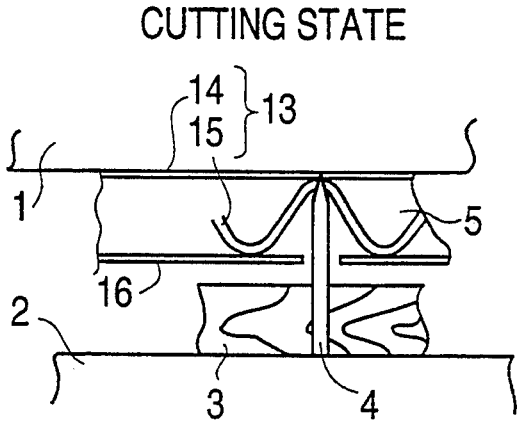
FIG. 3 is a cross-sectional view showing a secondary cutting state of the corrugated cardboard sheet at the portion P in FIG. 1.
Figure 4:
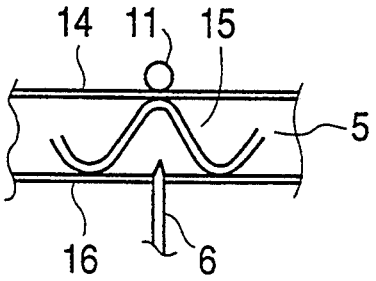
FIG. 4 is a cross-sectional view showing a primary cutting state of the corrugated cardboard sheet at the portion R in FIG. 1.
Figure 5:
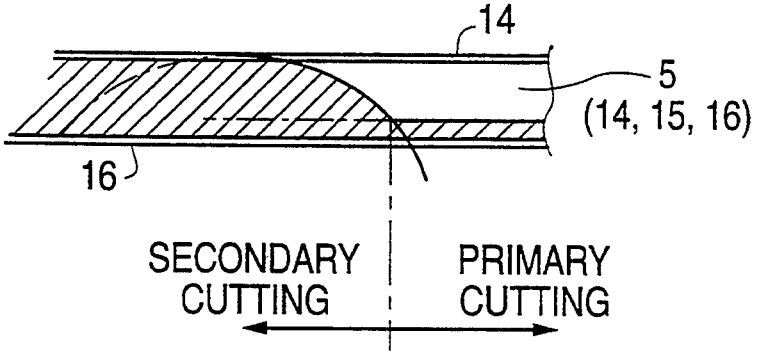
FIG. 5 is a figure for explaining the primary and secondary cutting states by a cutter knife in FIG. 1.
Figure 6:
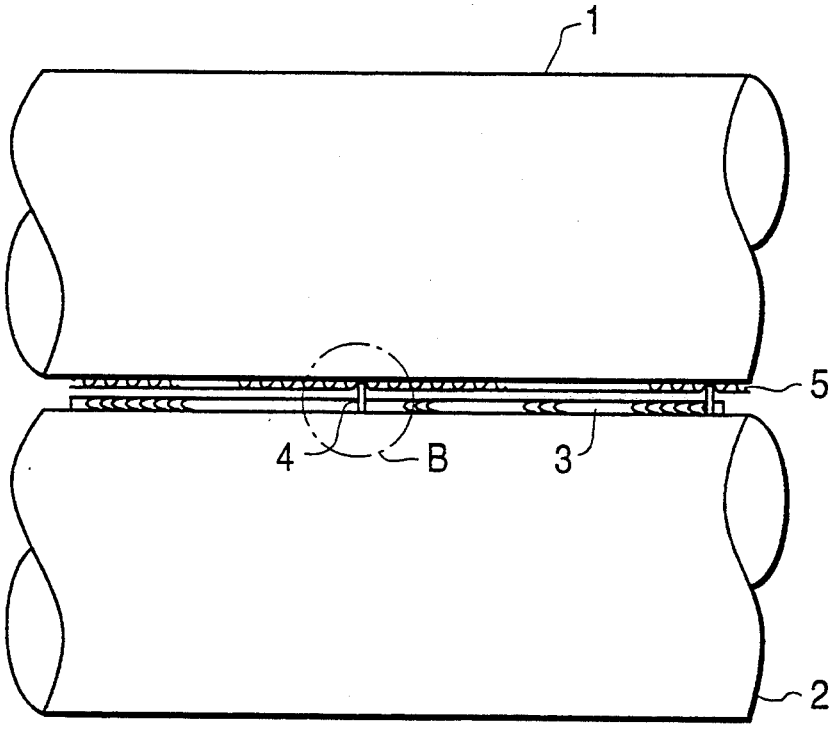
FIG. 6 PRIOR ART
FIG. 6 is a front view showing the cutting apparatus for corrugated cardboard sheets in the prior art.
Figure 7:
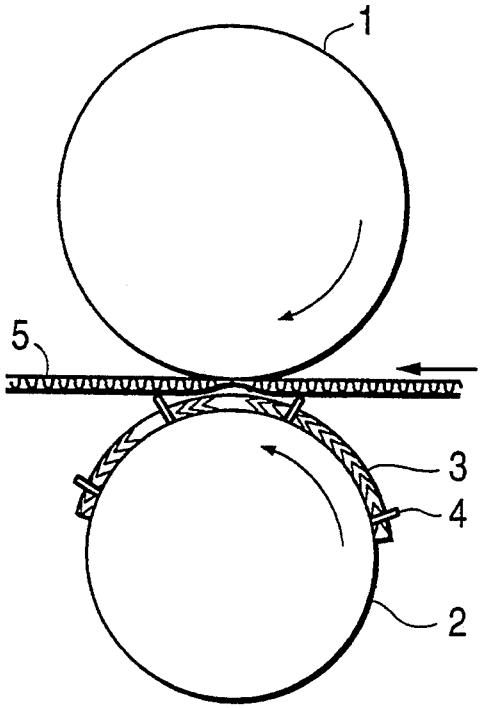
FIG. 7 PRIOR ART
FIG. 7 is a side view of FIG. 6.
Figure 8:
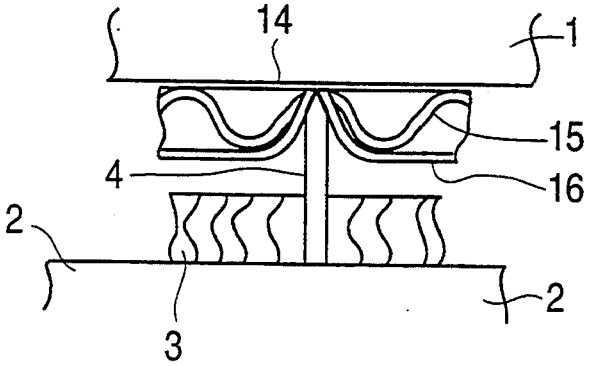
FIG. 8 PRIOR ART
FIG. 8 is a detailed cross-sectional view at the position B in FIG. 6.
Figure 9:
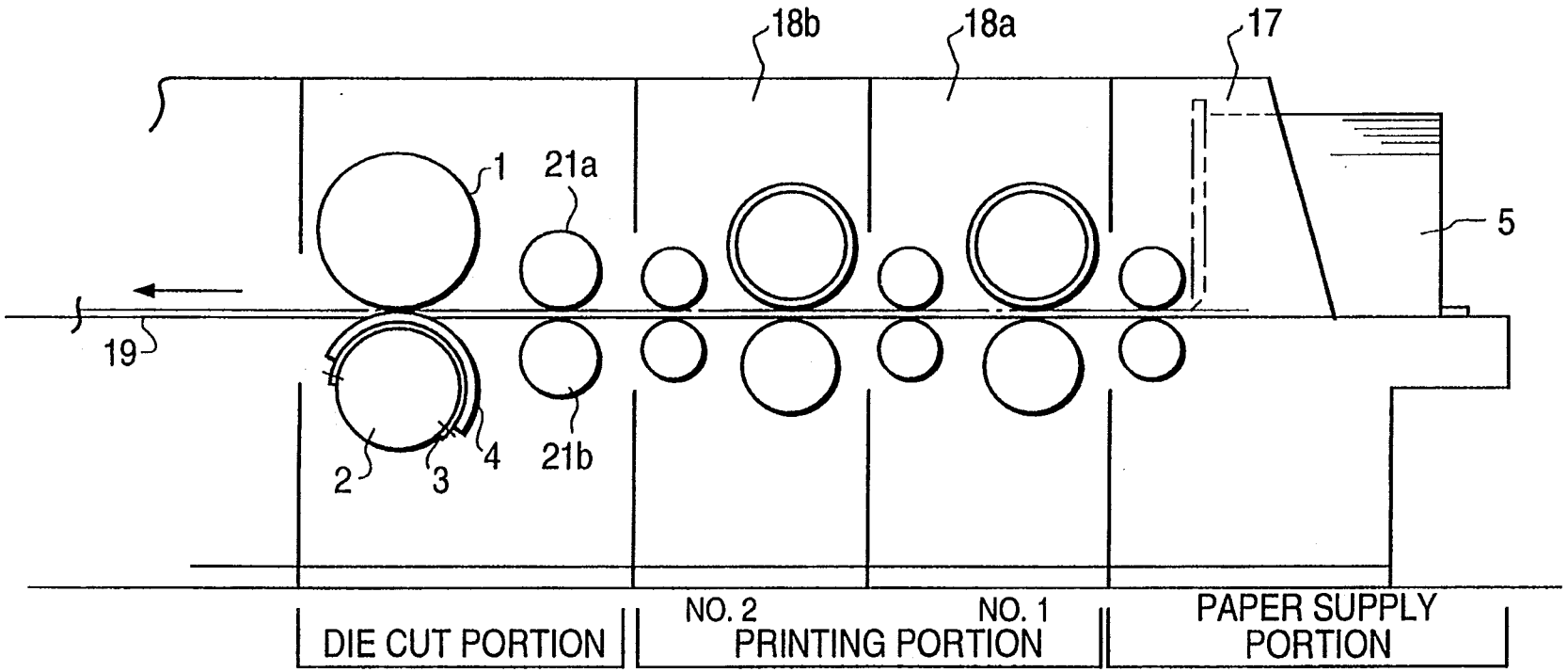
FIG. 9 PRIOR ART
FIG. 9 is a side view of the corrugated cardboard sheet processing machine in the prior art.
Figure 10:
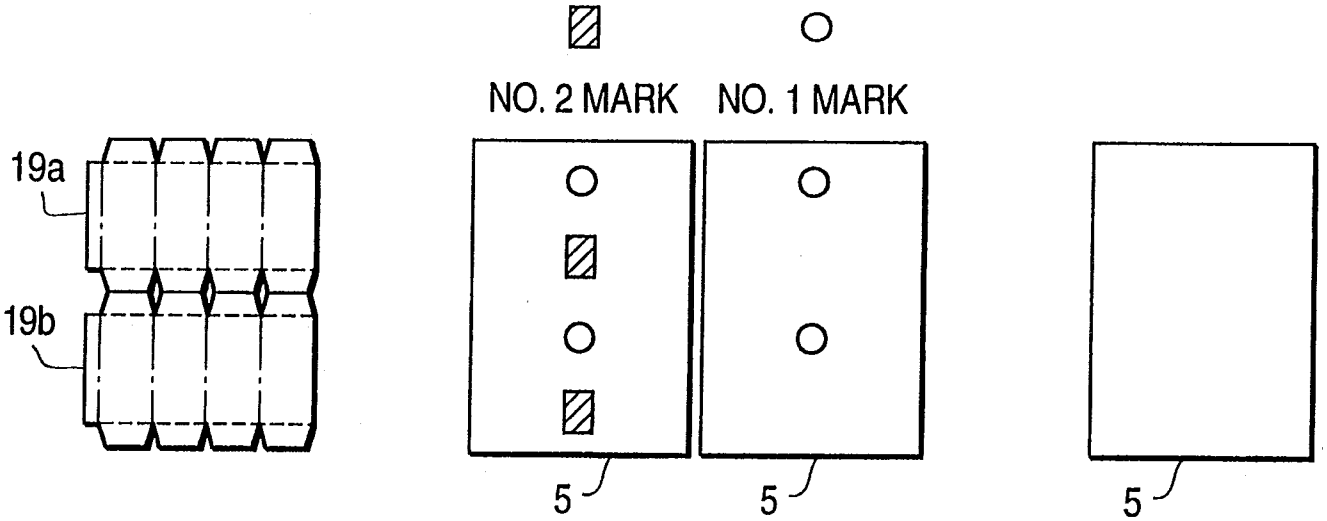
FIG. 10 PRIOR ART
FIG. 10 is a figure for explaining processing states of a corrugated cardboard sheet corresponding to the paper supply portion, the printing portion and the die cut portion in FIG. 9.

Next, the function of the present embodiment will be explained as follows. Prior to the secondary cutting (complete cutting), preliminary cutting is performed as the primary cutting for cutting a part of the sheet 5 by means of the cutter knife 6, and the final cutting is performed along a cut (cut-in) line thereof. Namely, as shown in FIG. 3 to FIG. 5, the preliminary cutting as the primary cutting is set such that only the liner portion 16 at one side (the reverse side) is mainly cut as shown in FIG. 4 and FIG. 5. Therefore, in the secondary cutting (final cutting) in FIG. 3, cutting is performed only for the liner 14 at one side (the face) and the center core 15 of the corrugated cardboard sheet 13, and sudden pulling at the liner 16 at the reverse side can be avoided, so that disadvantages such as cracks (footprints of a crow) and breaks generated at the cut portion and the like can be prevented, and the crush at the end portion of the sheet disappears, resulting in increase in quality of product sheets. Incidentally, the present system can be applied to cutting of various composite sheets such as one-side or double-sided corrugated cardboard sheets and the like by adjusting a projection of the cutter knife. In addition, the present invention is not limited to the above-mentioned embodiment only with respect to the type of the complete cutting apparatus portion and the structure of the liner cut portion (preliminary cutting portion).

EFFECTS OF THE INVENTION

As explained above in detail, according to the present invention, in the cutting apparatus of the type for dividing one sheet into plural sheets in the widthwise direction such as the two takes, three takes and the like, at the upstream from the cutting apparatus of the conventional type for performing the secondary cutting, one side of the liner portion is subjected to the primary (preliminary) cutting by means of the cutter knife, after which the secondary complete cutting is carried out coinciding with the above cutting line by means of the above-mentioned cutting apparatus, so that there is no action of sudden pulling on the liner, and cracks and breaks generated at the cut portion can be prevented, resulting in obtaining a clear cut face. In addition, at the secondary cutting portion, cutting is performed for only the core paper and one side of the liner portion, so that little compression deformation is given, and the crush at the cut portion of the sheet disappears.

What is claimed is:

1. A cutting apparatus for corrugated cardboard sheets which cuts and separates a corrugated cardboard sheet proceeding in a direction of travel, said cutting apparatus comprising:

(a) first means for cutting a corrugated cardboard sheet having a front liner, a rear liner and a core there between, the first cutting means comprising a preliminary cutting means for cutting at least the front liner portion of said corrugated cardboard sheet; and (b) a secondary cutting means for cutting completely through the corrugated cardboard sheet at least where said preliminary cutting means cut at least the front liner portion of said corrugated cardboard sheet;

wherein said preliminary cutting means comprises a bracket in an upstream position relative to said secondary cutting means, said bracket being adjustable in a widthwise direction of said cardboard sheet, said bracket comprising a cutter knife having an adjustable knife edge and a sheet Guide provided at the opposite side of the corrugated sheet;

wherein said bracket is engagable with a tie bar provided latitudinally in said widthwise direction of said cardboard sheet, and said cutter knife being movable in an axial direction of said tie bar and being fixable in a predetermined position; and wherein said sheet guide is engaged with a guide rod provided latitudinally in the widthwise direction of the sheet, and said sheet guide is capable of movement in the axial direction of the same guide rod and capable of fixing at a predetermined position.

2. A cutting apparatus for corrugated cardboard sheets which cuts and separates a corrugated cardboard sheet proceeding in a direction of travel, said cutting apparatus comprising:

(a) first means for cutting a corrugated cardboard sheet having a front liner, a rear liner and a core there between, the first cutting means comprising a preliminary cutting means for cutting at least the front liner portion of said corrugated cardboard sheet; and (b) a secondary cutting means for cutting completely through the corrugated cardboard sheet at least where said preliminary cutting means cut at least the front liner portion of said corrugated cardboard sheet;

wherein said preliminary cutting means comprises a bracket in an upstream position relative to said secondary cutting means, said bracket being adjustable in a widthwise direction of said cardboard sheet, said bracket comprising a cutter knife having an adjustable knife edge and a sheet guide provided at the opposite side of the corrugated sheet; and wherein said sheet guide is capable of adjustment of a distance to the knife edge of the cutter knife.

3. The cutting apparatus for corrugated cardboard sheets as claimed in claim 2 wherein said sheet guide is engaged with a guide rod provided latitudinally in the widthwise direction of the sheet, and said sheet guide is capable of movement in the axial direction of the same guide rod and capable of fixing at a predetermined position.

4. The cutting apparatus for corrugated cardboard sheets as claimed in claim 2 wherein the bracket provided with said cutter knife is engaged with a tie bar provided latitudinally in the widthwise direction of the sheet, and said cutter knife is capable of movement in the axial direction of the same tie bar and capable of fixing at a predetermined position.

5. The cutting apparatus for corrugated cardboard sheets as claimed in claim 4 wherein said sheet guide is engaged with a guide rod provided latitudinally in the widthwise direction of the sheet, and said sheet guide is capable of movement in the axial direction of the same guide rod and capable of fixing at a predetermined position.

6. A cutting apparatus for corrugated cardboard sheets which cuts and separates a corrugated cardboard sheet proceeding in a direction of travel, said cutting apparatus comprising:

(a) first means for cutting a corrugated cardboard sheet having a front liner, a rear liner and a core there between first cutting means comprising a preliminary cutting means for cutting at least the front liner portion of said corrugated cardboard sheet; and (b) a secondary cutting means for cutting completely through the corrugated cardboard sheet at least where said preliminary cutting means cut at least the front liner portion of said corrugated cardboard sheet;

wherein said preliminary cutting means comprises a bracket in an upstream position relative to said secondary cutting means, said bracket being adjustable in a widthwise direction of said cardboard sheet, said bracket comprising a cutter knife having an adjustable knife edge and a sheet guide provided at the opposite side of the corrugated sheet; and wherein said sheet guide is engagable with a guide rod provided latitudinally in said widthwise direction of said cardboard sheet, said sheet guide being moveable in an axial direction of said guide rod and being fixable in a predetermined position.

* * * * *